US006588952B1

(12) United States Patent
Silverbrook et al.

(10) Patent No.: US 6,588,952 B1
(45) Date of Patent: Jul. 8, 2003

(54) INK FEED ARRANGEMENT FOR A PRINT ENGINE

(75) Inventors: Kia Silverbrook, Balmain (AU); Tobin Allen King, Cremorne (AU); Garry Raymond Jackson, Haberfield (AU)

(73) Assignee: Silverbrook Research Pty Ltd, Balmain (AU)

( * ) Notice: Subject to any disclaimer, the term of this patent is extended or adjusted under 35 U.S.C. 154(b) by 239 days.

(21) Appl. No.: 09/607,991

(22) Filed: Jun. 30, 2000

(51) Int. Cl.[7] ..... B41J 2/305

(52) U.S. Cl. ..... 400/124.11; 400/120.1; 347/20; 347/42; 347/47; 347/65

(58) Field of Search ..... 400/124.11, 124.1; 347/20, 40, 42, 47, 50, 85, 86, 87, 88, 89, 65

(56) References Cited

U.S. PATENT DOCUMENTS 4,320,406 A 3/1982 Heinzl
4,771,295 A 9/1988 Baker et al.
6,199,974 B1 * 3/2001 Chen ..... 347/85
6,293,658 B1 * 9/2001 Silverbrook ..... 347/85
6,312,114 B1 * 11/2001 Silverbrook ..... 347/85

FOREIGN PATENT DOCUMENTS

EP 908317 4/1999

* cited by examiner

*Primary Examiner*—Andrew H. Hirshfeld
*Assistant Examiner*—Darius N. Cone

(57) ABSTRACT

An ink feed arrangement for feeding ink to a printhead of a print engine includes a spine portion. A casing is mounted over the spine portion, the spine portion and the casing defining a plurality of parallel, but isolated, ink supply galleries. A plurality of substantially aligned, spaced ink feed outlets are defined in the spine portion for feeding inks to the printhead. A feed passage is associated with each outlet for placing that outlet in fluid communication with one of the galleries.

10 Claims, 11 Drawing Sheets

INK FEED ARRANGEMENT FOR A PRINT ENGINE

FIELD OF THE INVENTION

This invention relates to a print engine. The invention has particular application in a print engine for use in an instantaneous print, digital camera. More particularly, this invention relates to an ink feed arrangement for feeding ink to a printhead of the print engine.

BACKGROUND TO THE INVENTION

In a multi-color printhead, in particular a page width printhead, it is necessary to feed the different colors of ink, including, if necessary, ink which is invisible in the infrared spectrum only, to the printhead while maintaining the different colors of ink strictly isolated from each other. Due to the small dimensions of the printhead, an arrangement is required which can feed the various colors of inks to various parts of the printhead accurately.

Also, it is desirable to make the ink feed arrangement as compact as possible to achieve a compact form of print engine.

By "page width" is meant that the printhead prints one line at a time on the print media without traversing the print media, or rastering, as the print media moves past the printhead.

SUMMARY OF THE INVENTION

According to the invention, there is provided an ink feed arrangement for feeding ink to a printhead of a print engine, the ink feed arrangement including a spine portion;

a casing mounted over the spine portion, the spine portion and the casing defining a plurality of parallel, but isolated, ink supply galleries;

a plurality of substantially aligned, spaced ink feed outlets defined in the spine portion for feeding inks to the printhead; and a feed passage associated with each outlet for placing that outlet in fluid communication with one of the galleries.

The printhead may be a page width printhead printing various types of ink on print media, the printhead having a group of microelectromechanical systems (MEMS) devices for each type of ink, and the ink feed arrangement may include a plurality of ink feed outlets for each group of MEMS devices of the printhead.

The feed outlets may be arranged in groups, each group of feed outlets comprising one feed outlet for each type of ink. Each feed outlet may feed ink, of the particular type, to an associated inlet opening of an ink supply member of the printhead.

The outlets may be arranged in a central, axial region of the spine, the passages associated with the feed outlet of each group of outlets radiating from said central regions in different directions. In other words, the passages may be, in effect, interdigitated in respect of each group of feed outlets.

The printhead may be received in said central, axial region of the spine with its ink supply member in communication with the ink feed arrangement.

An air supply channel may be defined in the spine portion alongside the printhead.

The spine portion may be supported on a support member, an electrical connector for providing electrical signals to the printhead being held captive between the spine portion and the support member. The electrical connector may comprise a tape automated bond (TAB) film. A flexible circuit board may be electrically connected to the TAB film, the support member including a raised formation, which urges the flexible circuit board into electrical contact with the TAB film.

A cap portion may be received over the casing for protecting the casing and defining a bearing surface against which a separating means bears for separating a piece of the print media, after an image has been printed thereon, from a remainder of the supply of print media.

BRIEF DESCRIPTION OF THE DRAWINGS

The invention will now be described by way of example with reference to the accompanying diagrammatic drawings in which.

DETAILED DESCRIPTION OF THE DRAWINGS

Figure 1:
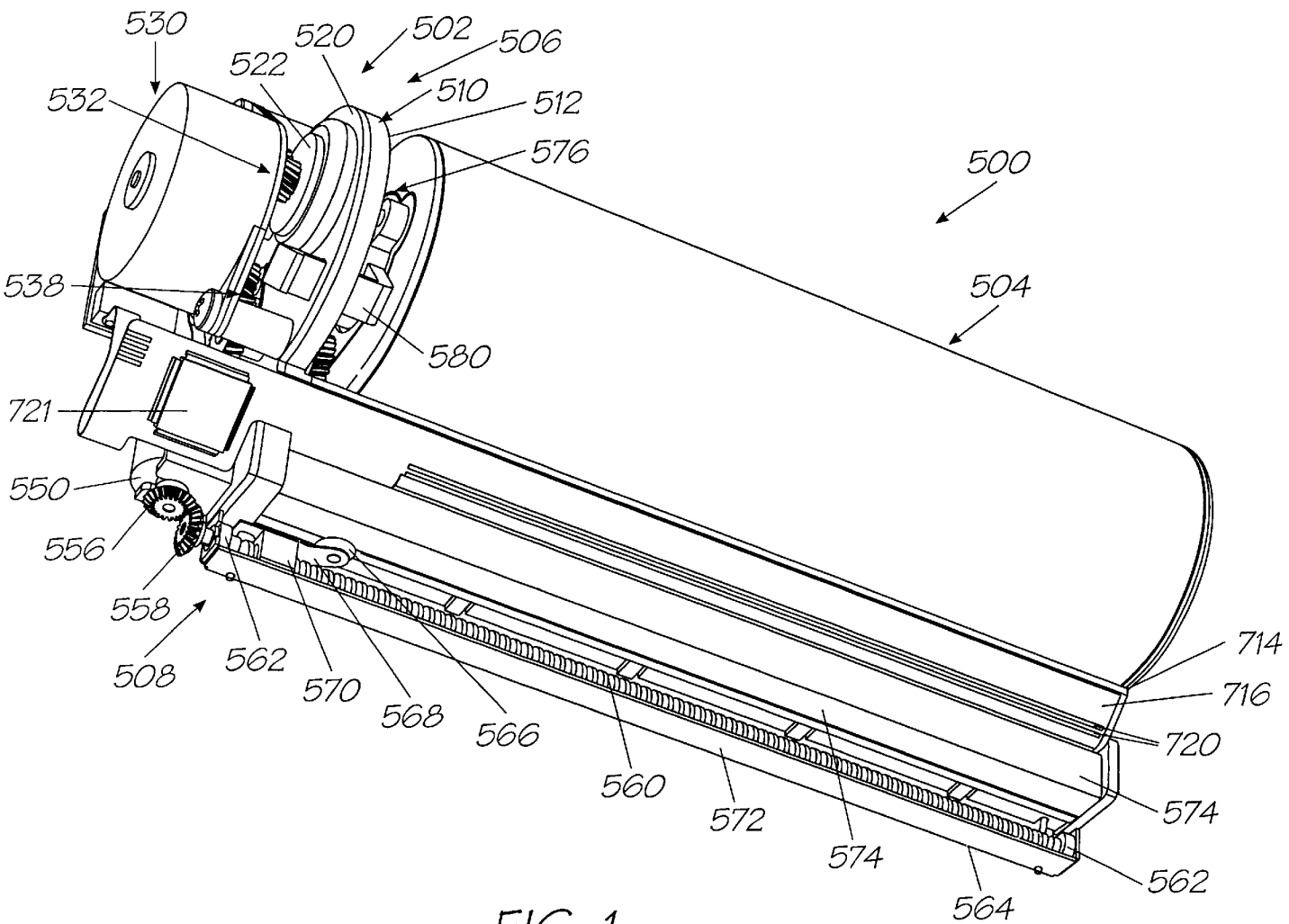
FIG. 1 shows a three dimensional view of a print engine, including components in accordance with the invention.

In the drawings, reference numeral 500 generally designates a print engine, in accordance with the invention. The print engine 500 includes a print engine assembly 502 on which a print roll cartridge 504 is removably mountable.

The print cartridge 504 is described in greater detail in our co-pending applications entitled "A Print Cartridge" and "An Ink Cartridge" filed simultaneously herewith as U.S. Ser. Nos. 09/607,993 and 09/607,251 respectively, and U.S. Pat. Nos. 6,238,044 and 6,425,661, respectively, contents of that disclosure being specifically incorporated herein by reference.

The print engine assembly 502 comprises a first sub-assembly 506 and a second, printhead sub-assembly 508.

Figure 5:
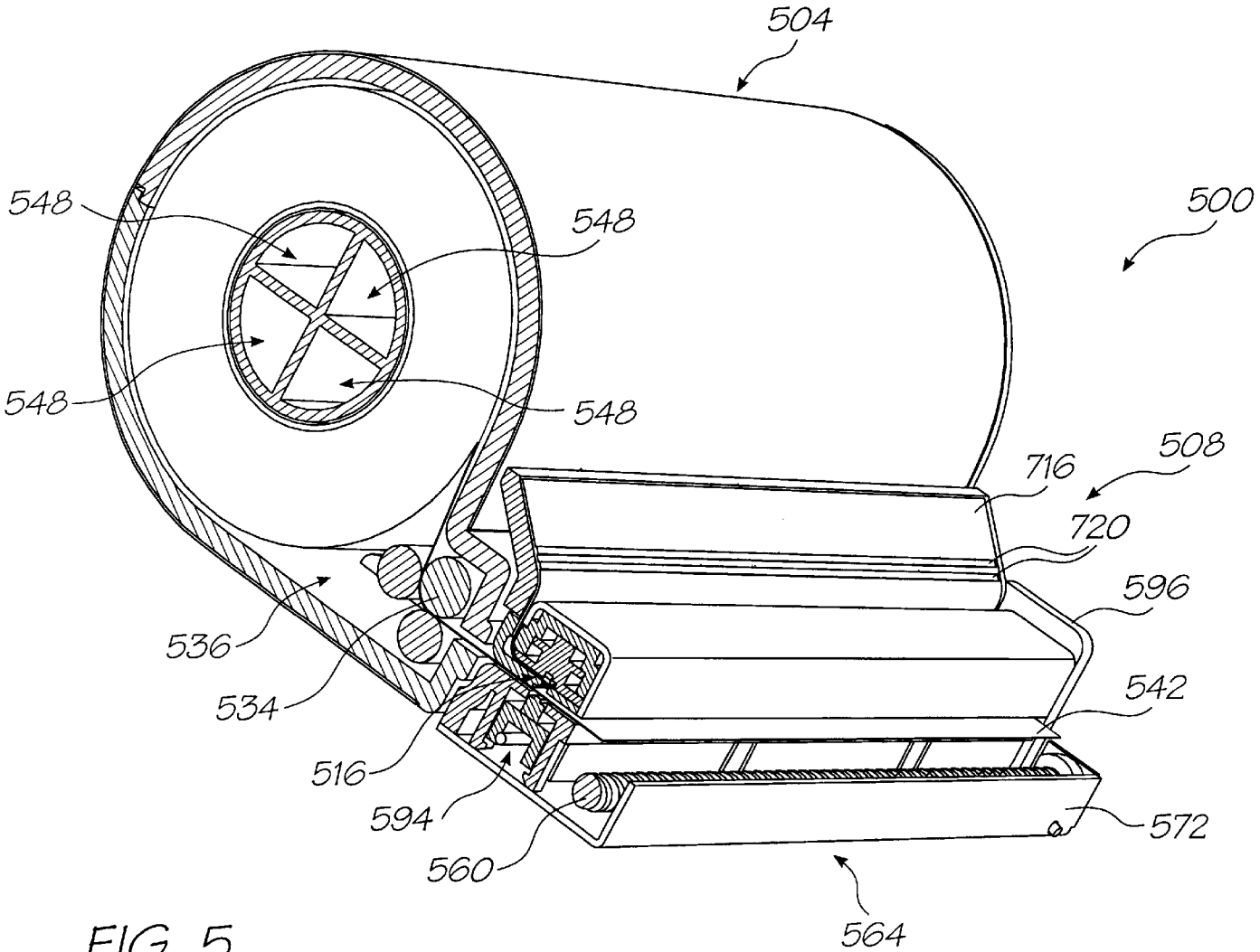
FIG. 5 shows a three dimensional, sectional view of the print engine.
Figure 6:
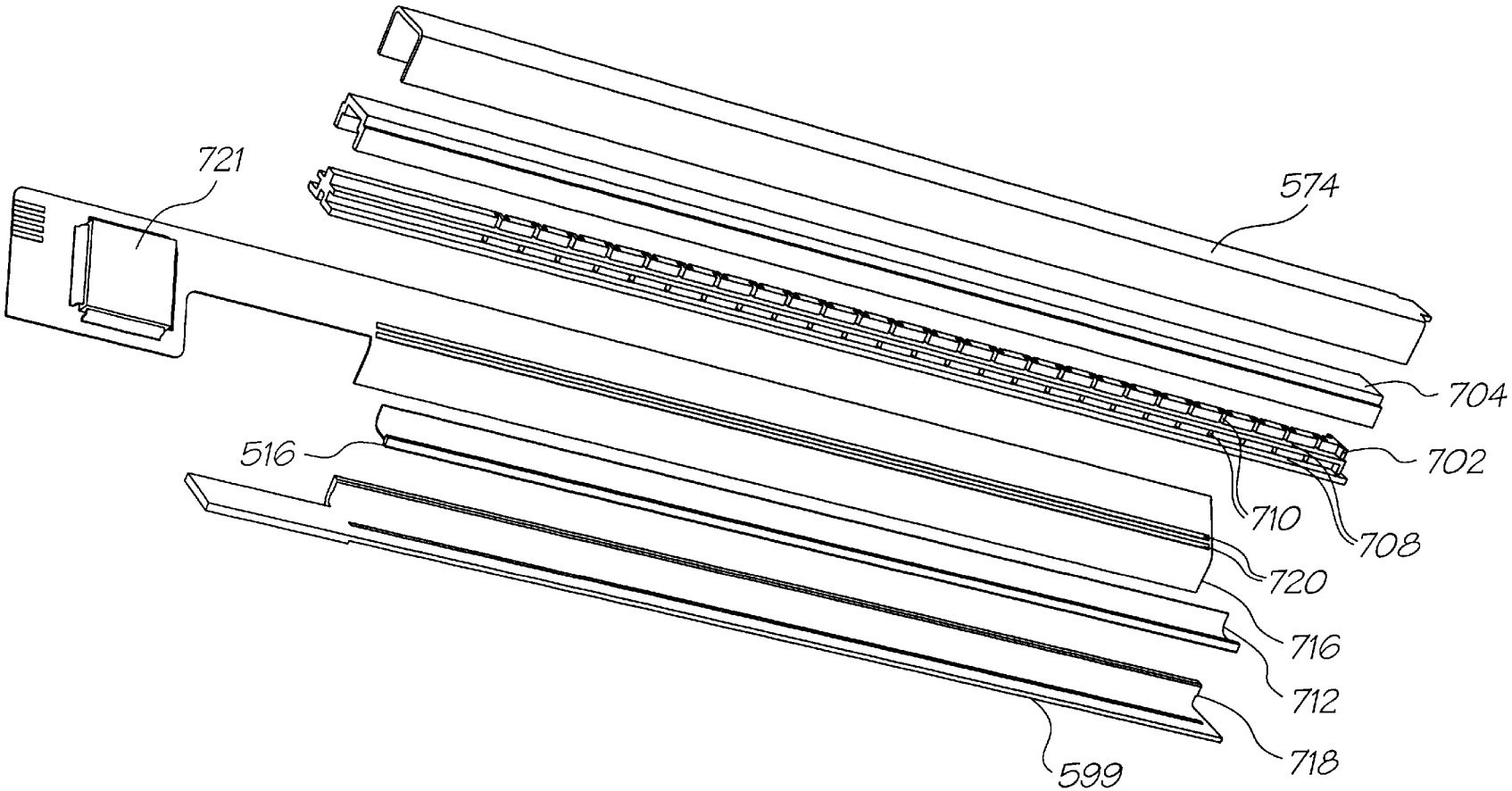
FIG. 6 shows a three dimensional, exploded view of a printhead sub-assembly of the print engine.

The sub-assembly 506 includes a chassis 510. The chassis 510 comprises a first molding 512 in which ink supply channels 514 are molded. The ink supply channels 514 supply inks from the print cartridge 504 to a printhead 516 (FIGS. 5 to 7) of the printhead sub-assembly 508. The printhead 516 prints in four colors or three colors plus ink which is visible in the infrared light spectrum only (hereinafter referred to as 'infrared ink'). Accordingly, four ink supply channels 514 are defined in the molding 512 together with an air supply channel 518. The air supply channel 518 supplies air to the printhead 516 to inhibit the build up of foreign particles on a nozzle guard of the printhead 516.

The chassis 510 further includes a cover molding 520. The cover molding 520 supports a pump 522 thereon. The pump 522 is a suction pump, which draws air through an air filter in the print cartridge 504 via an air inlet pin 524 and an air inlet opening 526. Air is expelled through an outlet opening 528 into the air supply channel 518 of the chassis 510.

Figure 2:
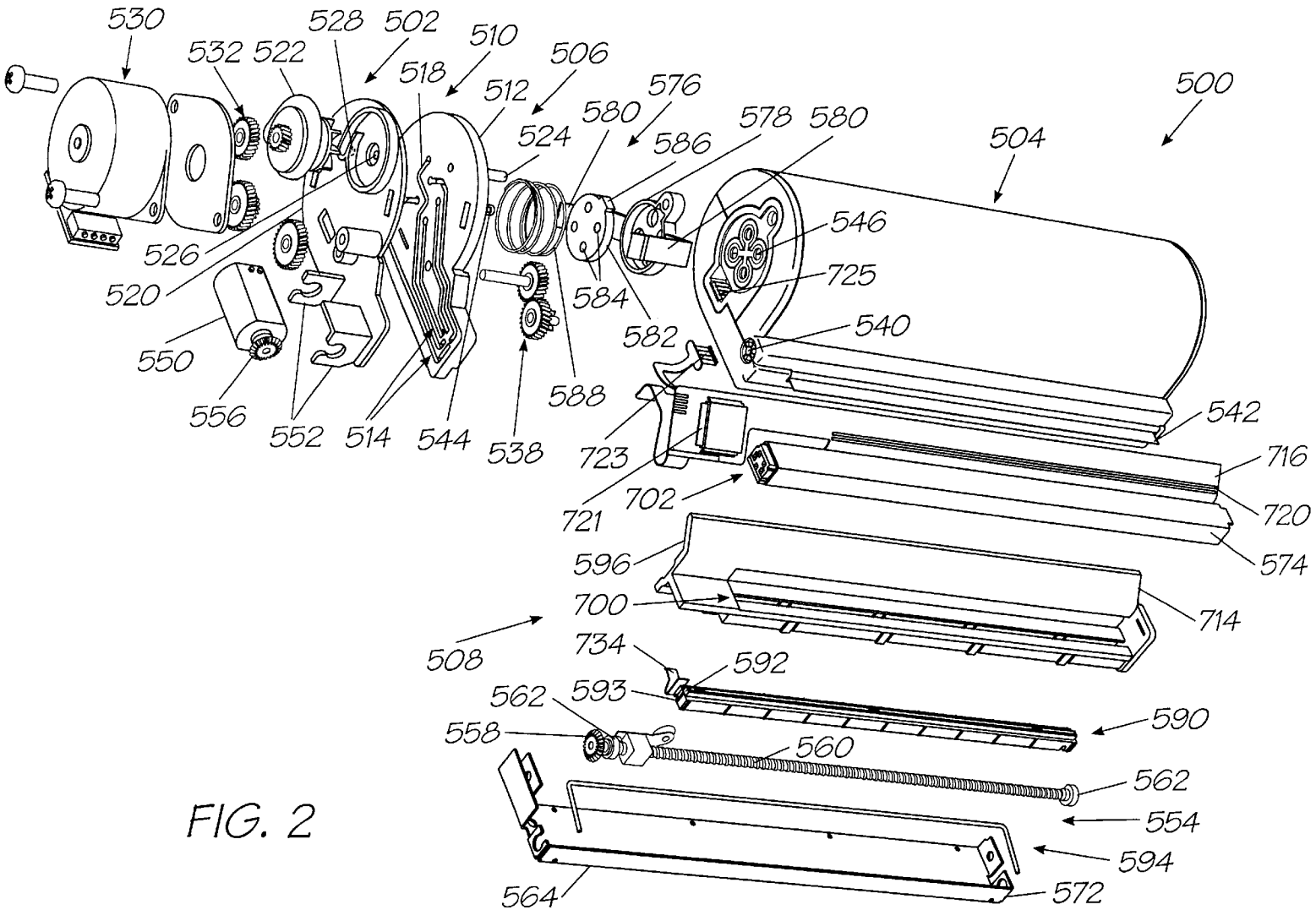
FIG. 2 shows a three dimensional, exploded view of the print engine.

The chassis 510 further supports a first drive motor in the form of a stepper motor 530. The stepper motor 530 drives the pump 522 via a first gear train 532. The stepper motor 530 is also connected to a drive roller 534 (FIG. 5) of a roller assembly 536 of the print cartridge 504 via a second gear train 538. The gear train 538 engages an engagable element 540 (FIG. 2) carried at an end of the drive roller 534. The stepper motor 530 thus controls the feed of print media 542 to the printhead 516 of the sub-assembly 508 to enable an image to be printed on the print media 542 as it passes beneath the printhead 516. It also to be noted that, as the stepper motor 530 is only operated to advance the print media 542, the pump 522 is only operational to blow air over the printhead 516 when printing takes place on the print media 542.

The molding 512 of the chassis 510 also supports a plurality of ink supply conduits in the form of pins 544 which are in communication with the ink supply channels 514. The ink supply pins 544 are received through an elastomeric collar assembly 546 of the print cartridge 504 for drawing ink from ink chambers or reservoirs 548 (FIG. 5) in the print cartridge 504 to be supplied to the printhead 516.

A second motor 550, which is a DC motor, is supported on the cover molding 520 of the chassis 510 via clips 552. The motor 550 is provided to drive a separating means in the form of a cutter arm assembly 554 to part a piece of the print media 542, after an image has been printed thereon, from a remainder of the print media. The motor 550 carries a beveled gear 556 on an output shaft thereof. The beveled gear 556 meshes with a beveled gear 558 carried on a worm gear 560 of the cutter assembly 554. The worm gear 560 is rotatably supported via bearings 562 in a chassis base plate 564 of the printhead sub-assembly 508.

The cutter assembly 554 includes a cutter wheel 566, which is supported on a resiliently flexible arm 568 on a mounting block 570. The worm gear 560 passes through the mounting block 570 such that, when the worm gear 56o is rotated, the mounting block 570 and the cutter wheel 566 traverse the chassis base plate 564. The mounting block 570 bears against a lip 572 of the base plate 564 to inhibit rotation of the mounting block 570 relative to the worm gear 560. Further, to effect cutting of the print media 542, the cutter wheel 566 bears against an upper housing or cap portion 574 of the printhead sub-assembly 508. This cap portion 574 is a metal portion. Hence, as the cutter wheel 566 traverses the capped portion 574, a scissors-like cutting action is imparted to the print media to separate that part of the print media 542 on which the image has been printed.

The sub-assembly 506 includes an ejector mechanism 576. The ejector mechanism 576 is carried on the chassis 510 and has a collar 578 having clips 580, which clip and affix the ejector mechanism 576 to the chassis 510. The collar 578 supports an insert 582 of an elastomeric material therein. The elastomeric insert 582 defines a plurality of openings 584. The openings 584 close off inlet openings of the pins 544 to inhibit the ingress of foreign particles into the pins 544 and, in so doing, into the channels 514 and the printhead 516. In addition, the insert 584 defines a land or platform 586 which closes off an inlet opening of the air inlet pin 524 for the same purposes.

Figure 3:
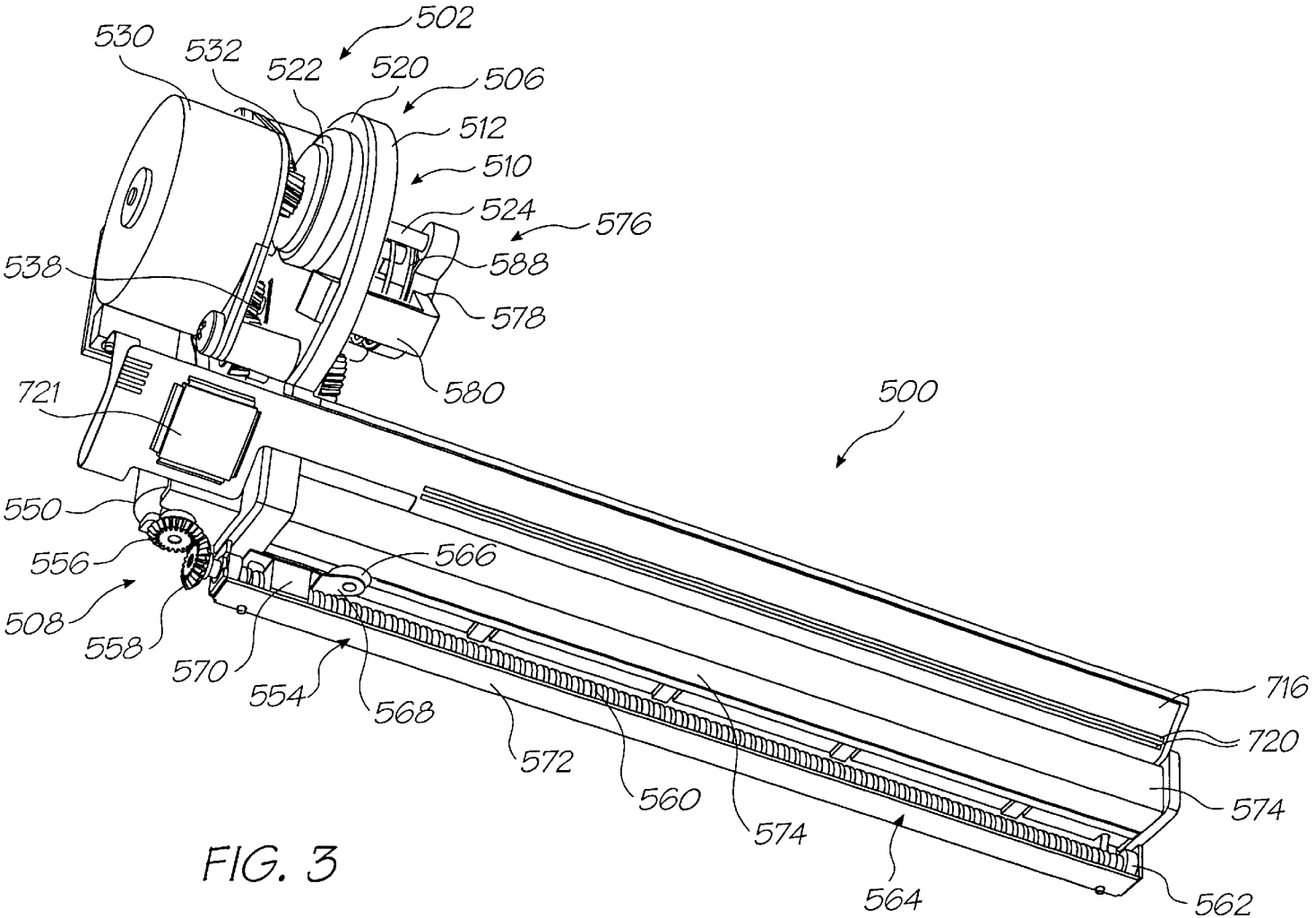
FIG. 3 shows a three dimensional view of the print engine with a removable print cartridge used with the print engine removed.
Figure 4:
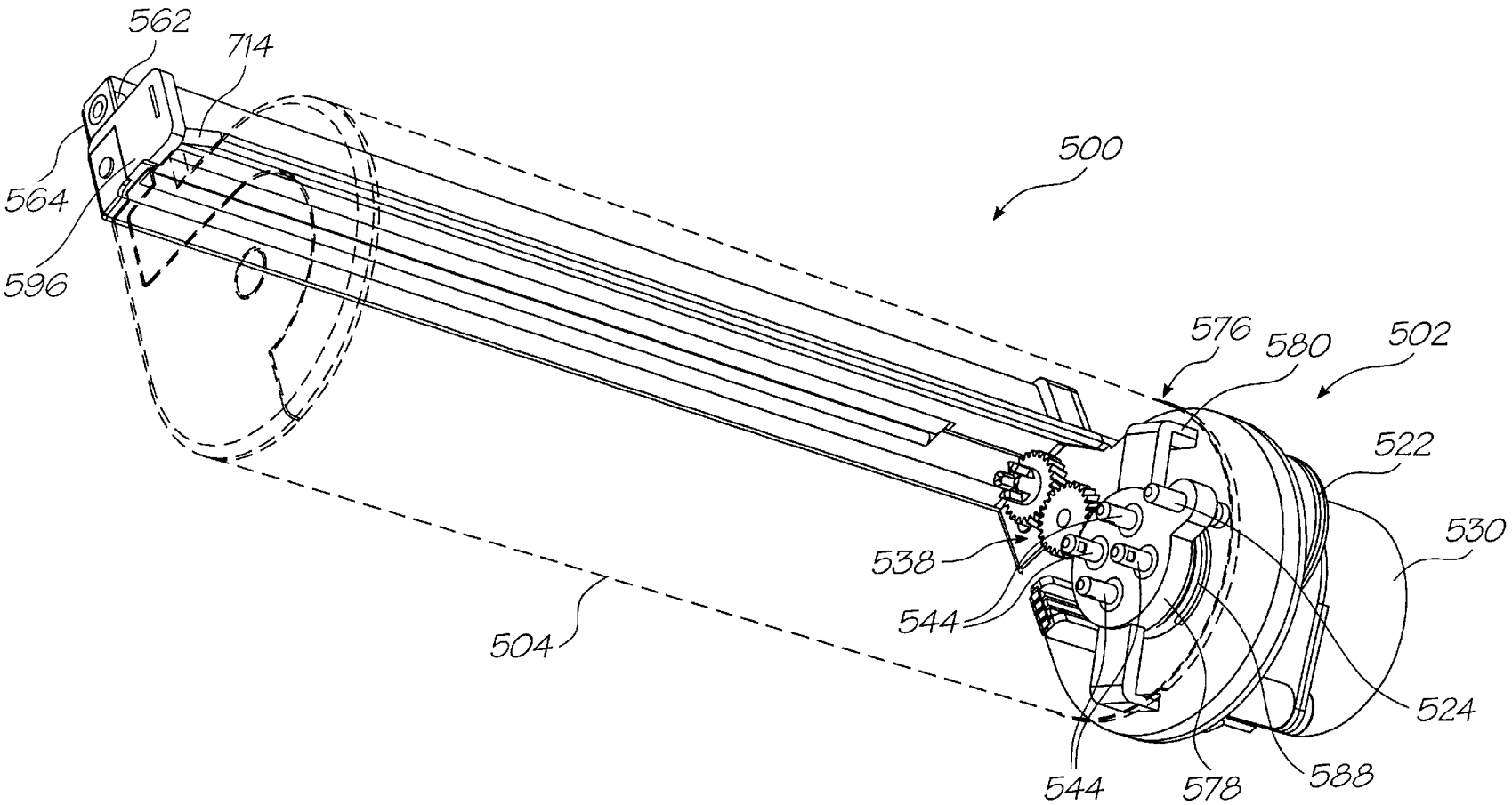
FIG. 4 shows a three dimensional, rear view of the print engine with the print cartridge shown in dotted lines.

A coil spring 588 is arranged between the chassis 510 and the collar 578 to urge the collar 578 to a spaced position relative to the chassis 510 when the cartridge 504 is removed from the print engine 500, as shown in greater detail in FIG. 3 of the drawings. The ejector mechanism 576 is shown in its retracted position in FIG. 4 of the drawings.

The printhead sub-assembly 508 includes, as described above, the base plate 564. A capping mechanism 590 is supported displaceably on the base plate 564 to be displaceable towards and away from the printhead 516. The capping mechanism 590 includes an elongate rib 592 arranged on a carrier 593. The carrier is supported by a displacement mechanism 594, which displaces the rib 592 into abutment with the printhead 516 when the printhead 516 is inoperative. Conversely, when the printhead 516 is operational, the displacement mechanism 594 is operable to retract the rib 592 out of abutment with the printhead 516.

The printhead sub-assembly 508 includes a printhead support molding 596 on which the printhead 516 is mounted. The molding 596, together with an insert 599 arranged in the molding 596, defines a passage 598 through which the print media 542 passes when an image is to be printed thereon. A groove 700 is defined in the molding 596 through which the capping mechanism 590 projects when the capping mechanism 590 is in its capping position.

An ink feed arrangement 702 is supported by the insert 599 beneath the cap portion 574. The ink feed arrangement 702 comprises a spine portion 704 and a casing 706 mounted on the spine portion 704. The spine portion 704 and the casing 706, between them, define ink feed galleries 708 which are in communication with the ink supply channels 514 in the chassis 510 for feeding ink via passages 710 (FIG. 7) to the printhead 516.

Figure 8:
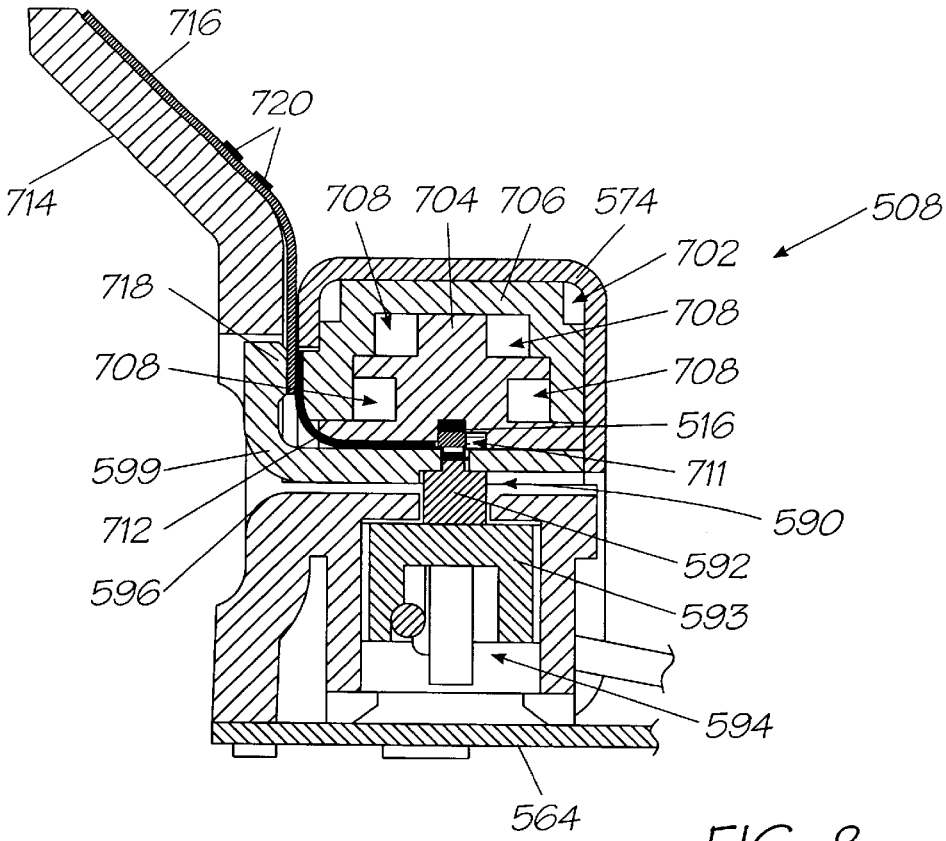
FIG. 8 shows a sectional end view of the printhead sub-assembly with a capping mechanism in a capping position.
Figure 9:
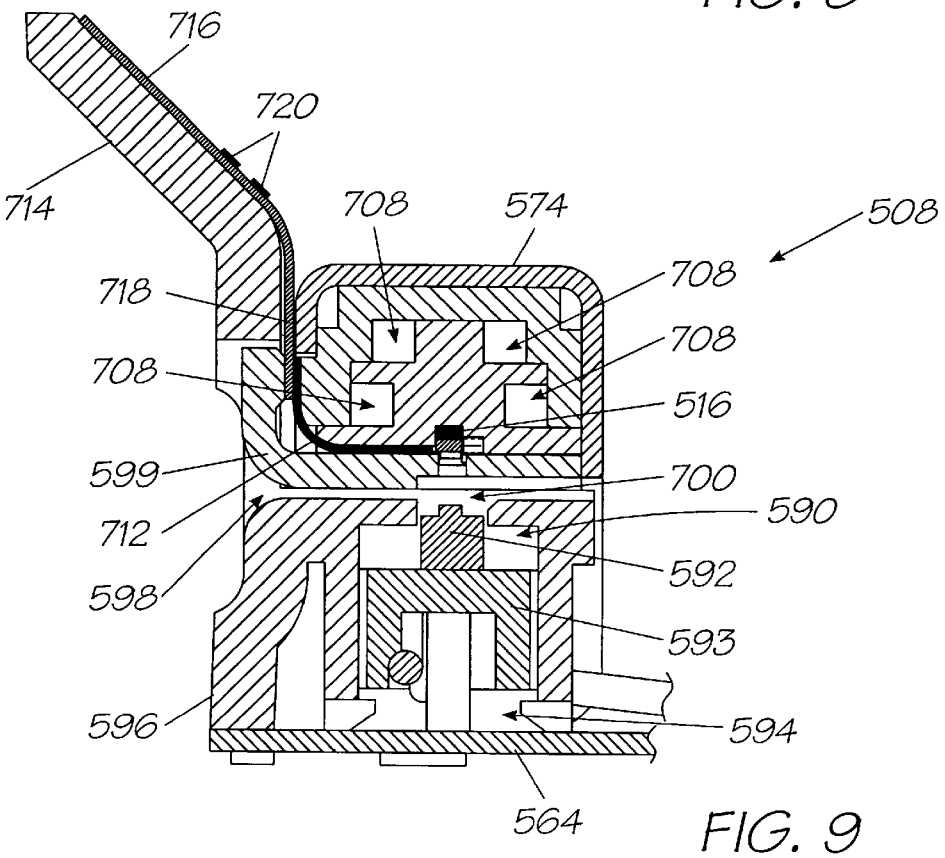
FIG. 9 shows the printhead sub-assembly with the capping mechanism in its uncapped position.

An air supply channel 711 (FIG. 8) is defined in the spine portion 704, alongside the printhead 516.

Electrical signals are provided to the printhead 516 via a TAB film 712 which is held captive between the insert 599 and the ink feed arrangement 702.

The molding 596 includes an angled wing portion 714. A flexible printed circuit board (PCB) 716 is supported on and secured to the wing portion 714. The flex PCB 716 makes electrical contact with the TAB film 712 by being urged into engagement with the TAB film 712 via a rib 718 of the insert 599. The flex PCB 716 supports busbars 720 thereon. The busbars 720 provide power to the printhead 516 and to the other powered components of the print engine 500. Further, a camera print engine control chip 721 is supported on the flex PCB 716 together with a QA chip (not shown) which authenticates that the cartridge 504 is compatible and compliant with the print engine 500. For this purpose, the PCB 716 includes contacts 723 which engage contacts 725 in the print cartridge 504.

Figure 7:
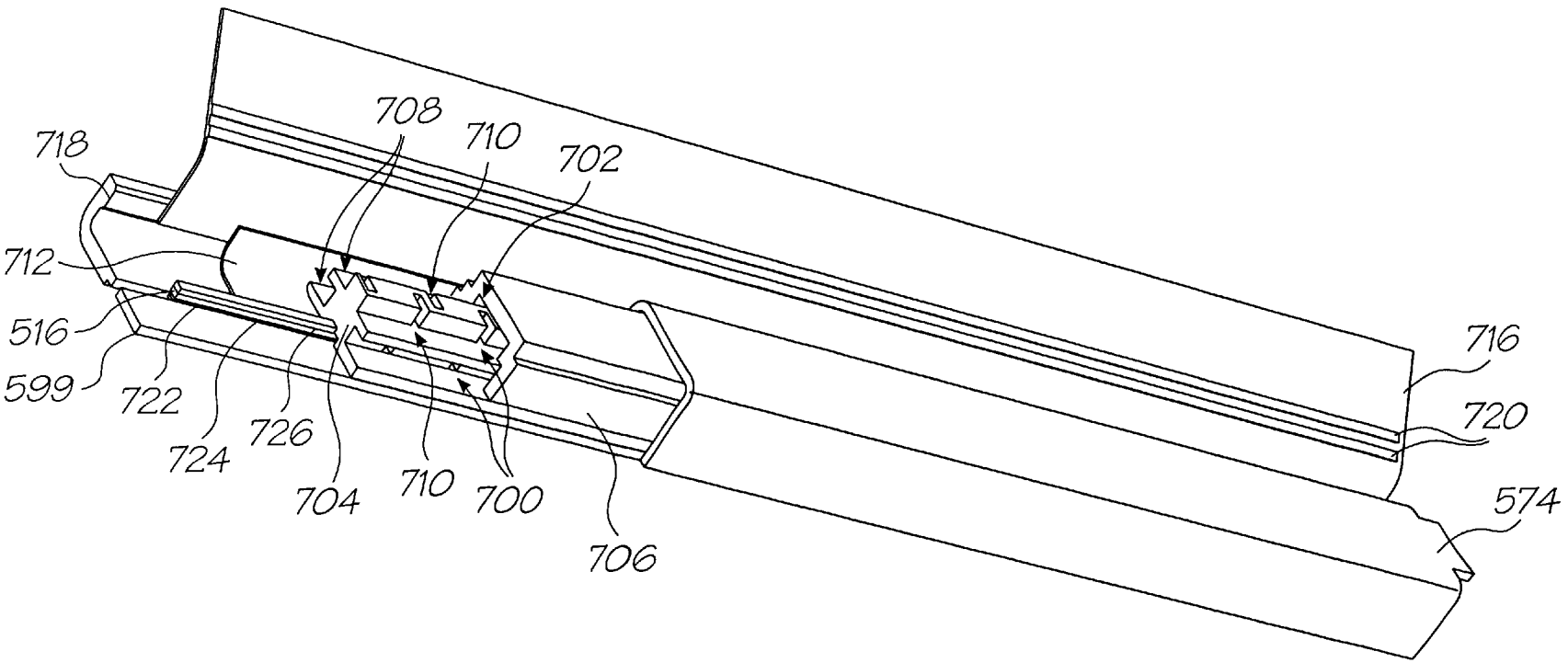
FIG. 7 shows a partly cutaway view of the printhead sub-assembly.

As illustrated more clearly in FIG. 7 of the drawings, the printhead itself includes a nozzle guard 722 arranged on a silicon wafer 724. The ink is supplied to a nozzle array 757 of the printhead 516 via an ink supply member 726. The ink supply member 726 communicates with outlets of the passages 710 of the ink feed arrangement 702 for feeding ink to the array of nozzles of the printhead 516, on demand.

Figure 14:
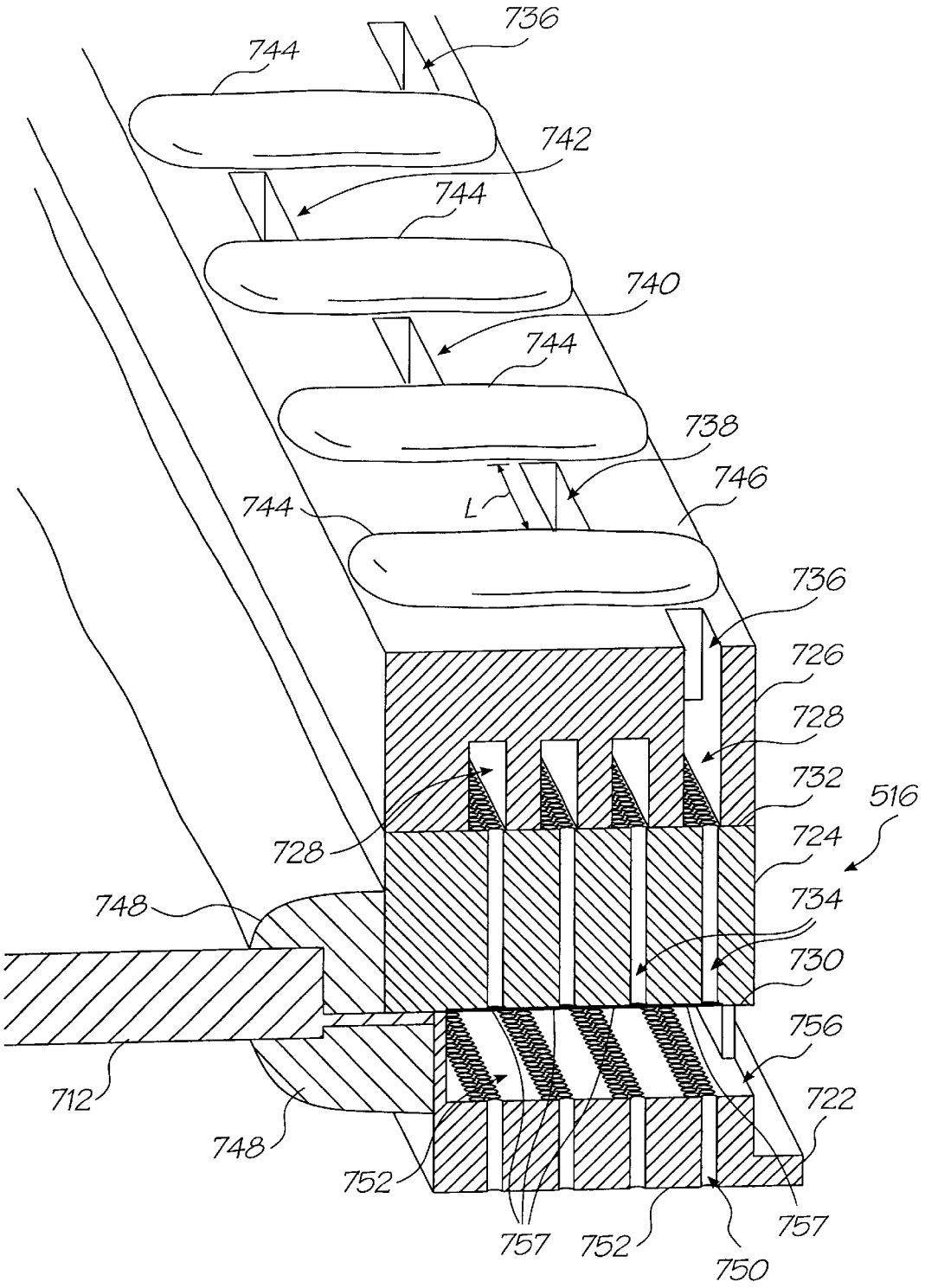
FIG. 14 shows a three dimensional, schematic view, on an enlarged scale, of the printhead, which communicates with the ink feed arrangement of FIGS. 10 to 13.

The ink supply member 726, which is shown in greater detail in FIG. 14 of the drawings, is a block of silicon wafer which is mounted on the silicon wafer 724. The member 726 has channels 728 formed therein. The channels 728 extend the length of the member 726. As described above, the printhead 516 is a multi-color printhead having nozzles (not shown) arranged in groups. Each group prints one color or the infrared ink. The nozzles 757 are MEMS devices mounted on a surface 730 of the silicon wafer 724 with the member 726 being mounted on an opposed surface 732 of the silicon wafer 724. Each nozzle is supplied by an ink supply passage 734 extending through the wafer 724.

Thus, each channel 728 of the block 726 communicates with its associated group of passages 734. Each channel 728 has a plurality of ink inlet openings 736, 738, 740 and 742. For example, the ink inlet openings 736 supply black ink to the first group of ink supply passages 734 of the wafer 724. Instead, where three colors and infrared ink are provided, the ink inlet openings 736 provide infrared ink to the first group of nozzles via their passages 734. The inlet openings 738 provide magenta ink to the second group of nozzles via their inlet passages 734. The ink inlet openings 740 provide yellow ink to the third group of nozzles via their passages 734. The final group of inlet openings 742 provide cyan ink to the fourth group of nozzles via their passages 734.

Each inlet opening 736, 738, 740, 742 is isolated from its neighboring opening via a transversely extending bead of sealing material 744. It will be appreciated that the ink feed arrangement 702 bears against the top surface 746 of the member 726 to isolate the openings 736 to 742 from one another.

Also, it is to be noted that the TAB film 712 is bonded to the surface 730 of the wafer 724 via beads of adhesive 748. The beads 748 further form a fluid tight seal against the side of the wafer 724.

Ink ejected from each MEMS device 757 is ejected through a passage 750 in the nozzle guard 722. To maintain a surface 752 of the nozzle guard and a region 754 between the nozzle guard 722 and the wafer 724 free of foreign particles, air is blown on to the surface 752 of the nozzle guard 722 and, via inlet openings 756 into the region 754.

The member 726 is a silicon wafer and, accordingly, the channels 728 and the inlet openings 736 to 742 are formed in the wafer 726 by etching techniques.

Referring to FIGS. 10 to 13, sections of the ink feed arrangement are shown. The sections are spaced approximately 0.5 millimeters from each other along the length of the ink feed arrangement 702. As described above, the spine portion 704 of the ink feed arrangement 702 has a plurality of passages 710 defined therein for feeding ink from the galleries 708 to the member 726 of the printhead 516.

It will be appreciated that each gallery 708 has a plurality of passages 710 associated with it. There are the same number of passages 710 associated with each gallery 708 as there are associated inlet openings 736, 738, 740 or 742 in the member 726 of the printhead 516.

Figure 10:
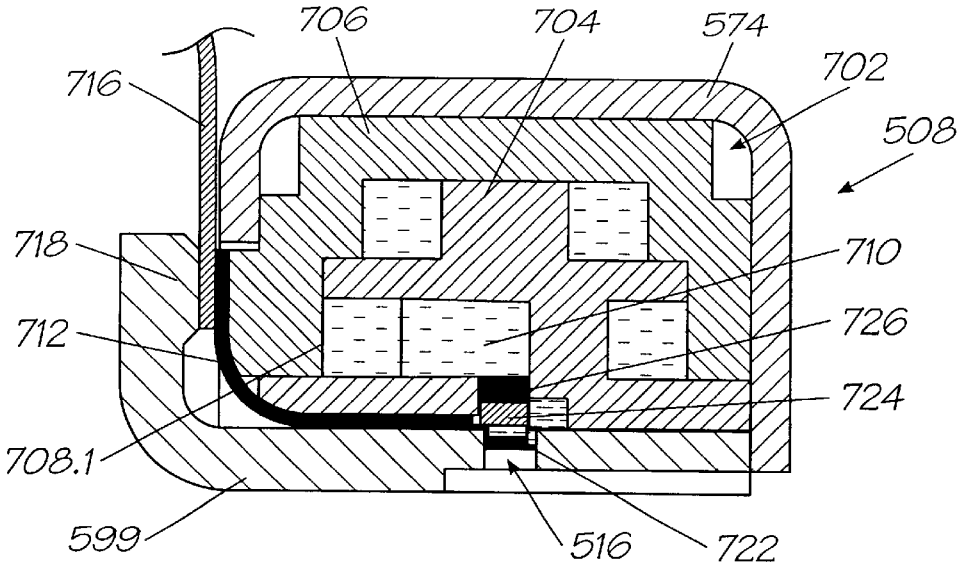
FIGS. 10 to 13 show various sections of part of the printhead sub-assembly, including an ink feed arrangement, in accordance with the invention.

Accordingly, as illustrated in FIG. 10 of the drawings, each passage 710 in communication with the gallery 708.1 feeds ink to its associated opening 742 in the member 726. The gallery 708.1 supplies cyan ink to the printhead 516.

Figure 11:
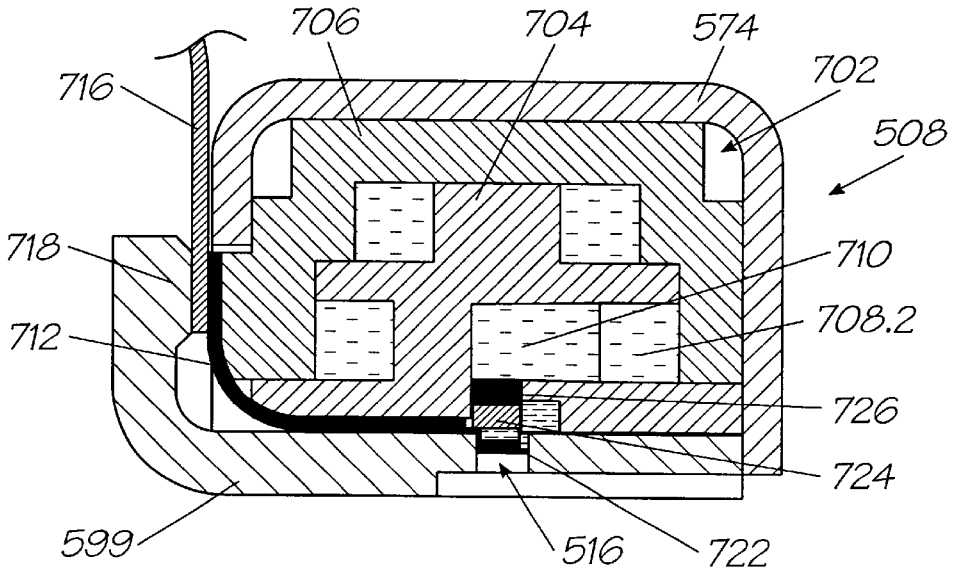
Figure 12:
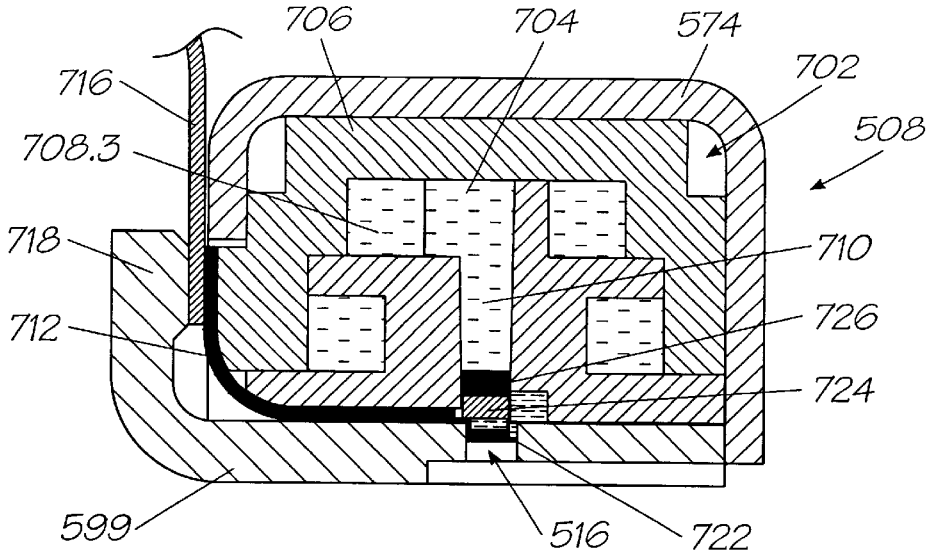
Figure 13:
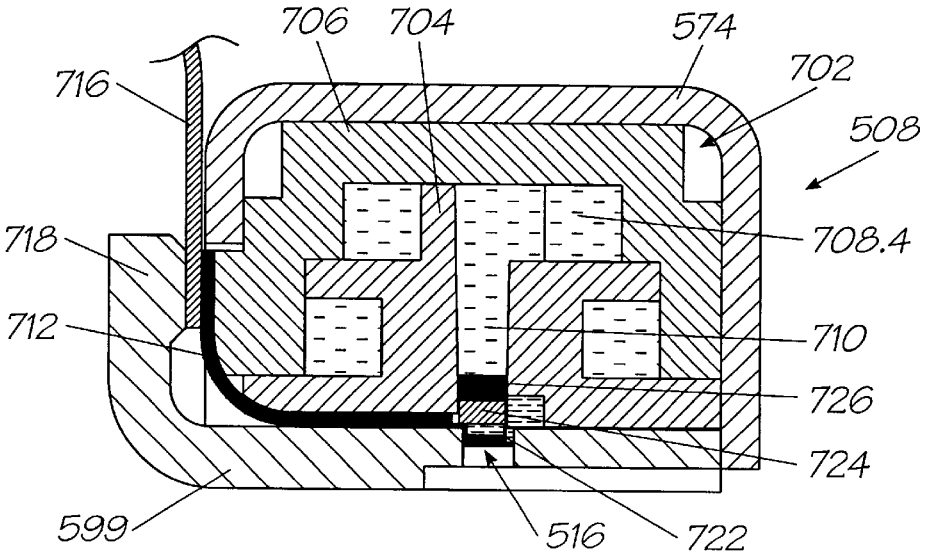

As shown in FIG. 11 of the drawings, the gallery 708.2 is in communication with the openings 736 in the member 726 via the passages 710 in fluid communication with the gallery 708.2. The gallery 708.2 supplies black ink or infrared ink, as the case may be, to the printhead 516.

The gallery 708.3 (FIG. 12) communicates with the openings 740 in the member 726 via the passages 710 in fluid communication with the gallery 708.3. The gallery 708.3 supplies yellow ink to the printhead 516.

Finally, the gallery 708.4 communicates with the openings 738 in the member 726 and the passages 710 feeding those openings 738 for supplying magenta ink to the printhead 516.

Accordingly, it is an advantage of the invention that, in combination with the ink supply member 726, a plastics molding can be used as the ink feed arrangement 702 for feeding ink to the printhead 516. The spacing between the passages 734 is of the order of one hundred micrometers. In contrast, the spacing between the openings 736 to 742 and, accordingly, the feed passages 710 is of the order of 0.5 millimeters. It will be appreciated that it is easier to mold a device having passages spaced 0.5 millimeters apart than it is. to fabricate a device where the spacing between openings is of the order of one hundred micrometers.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

We claim:

1. An ink feed arrangement for feeding ink to a print head of a print engine, the ink feed arrangement including an elongate spine portion;

an elongate casing mounted over the spine portion, the spine portion and the casing together defining a plurality of elongate ink supply galleries, the galleries extending substantially parallel with one another and with the spine portion and being substantially isolated from one another;

a plurality of substantially aligned, spaced ink feed outlets defined in the spine portion for feeding inks to the printhead; and a feed passage associated with each outlet for placing that outlet in fluid communication with one of the galleries.

2. The ink feed arrangement of claim 1 in which the printhead is a page width printhead printing various types of ink on print media, the printhead having a group of microelectromechanical systems (MEMS) devices for each type of ink and in which the ink feed arrangement includes a plurality of ink feed outlets for each group of MEMS devices of the printhead.

3. The ink feed arrangement of claim 2 in which the feed outlets are arranged in groups, each group of feed outlets comprising one feed outlet for each type of ink.

4. The ink feed arrangement of claim 3 in which the outlets are arranged in a central, axial region of the spine, the passages associated with the feed outlets of each group of outlets radiating from said central region in different directions.

5. The ink feed arrangement of claim 4 in which the printhead is received in said central, axial region of the spine.

6. The ink feed arrangement of claim 5 in which an air supply channel is defined in the spine portion alongside the printhead.

7. The ink feed arrangement of claim 5 in which the spine portion is supported on a support member, an electrical connector for providing electrical signals to the printhead being held captive between the spine portion and the support member.

8. The ink feed arrangement of claim 7 in which the electrical connector comprises a tape automated bond (TAB) film.

9. The ink feed arrangement of claim 8 in which a flexible circuit board is electrically connected to the TAB film, the support member including a raised formation, which urges the flexible circuit board into electrical contact with the TAB film.

10. The ink feed arrangement of claim 1 in which a cap portion is received over the casing.

* * * * *